US005425383A

United States Patent [19]

Garthaffner et al.

[11] Patent Number: 5,425,383

[45] Date of Patent: Jun. 20, 1995

[54] ALIGNMENT OF FILTER AND CIGARETTE COMPONENTS

[75] Inventors: Martin T. Garthaffner, Midlothian; Ronald D. Honaker, Powhatan, both of Va.

[73] Assignee: Philip Morris Incorporated, New York, N.Y.

[21] Appl. No.: 308,780

[22] Filed: Sep. 19, 1994

Related U.S. Application Data

[63] Continuation of Ser. No. 943,298, Sep. 10, 1992, abandoned.

[51] Int. Cl.[6] ..... A24C 5/52

[52] U.S. Cl. ..... 131/94

[58] Field of Search ..... 131/94

[56] References Cited

U.S. PATENT DOCUMENTS

| | | | |
|---|---|---|---|
| 3,340,882 | 9/1967 | Seragnoli | 198/347.3 |
| 3,384,094 | 5/1968 | Molins | 131/94 |
| 4,200,179 | 4/1980 | Hinz | 198/458 |
| 4,321,050 | 3/1982 | Oesterling | 493/95 |
| 4,519,405 | 5/1985 | Seragnoli | 131/94 |
| 4,531,629 | 7/1985 | Seragnoli et al. | 198/458 |
| 4,815,481 | 3/1989 | Hirose et al. | 131/94 |
| 4,867,734 | 9/1989 | Okumoto et al. | 493/48 |
| 5,232,079 | 8/1993 | Belcastro et al. | 198/372 |

FOREIGN PATENT DOCUMENTS

| | | | |
|---|---|---|---|
| 250727 | 1/1988 | European Pat. Off. . | |
| 1330957 | 8/1962 | France . | |
| 1428865 | 3/1965 | France . | |
| 2373241 | 7/1978 | France . | |
| 2510877 | 2/1983 | France . | |
| 2523820 | 9/1983 | France . | |
| 2809619 | 9/1979 | Germany . | |
| 959345 | 5/1964 | United Kingdom . | |
| 1179683 | 1/1970 | United Kingdom | A24C 5/50 |
| 2267021A | 11/1993 | United Kingdom | A24D 3/02 |

*Primary Examiner*—William H. Grieb

*Attorney, Agent, or Firm*—Kevin B. Osborne; James E. Schardt; Charles E. B. Glenn

[57] ABSTRACT

A filter tipped cigarette making machine and method in which spaced apart generally cylindrical components are supplied to flutes in processing drums. Gaps between the components are partially closed in a motion limiting spreader drum.

19 Claims, 3 Drawing Sheets

ALIGNMENT OF FILTER AND CIGARETTE COMPONENTS

This is a continuation of application Ser. No. 07/943,298 filed on Sep. 10, 1992, now abandoned.

BACKGROUND OF THE INVENTION

The present invention relates generally to an apparatus and method for producing and aligning components for forming a combined filter tipped cigarette without the use of a combining machine. More particularly, this invention relates to an apparatus and method for aligning the elements of a combined filter and a wrapped tobacco rod, closing gaps between the elements, and then wrapping the filter and a portion of the tobacco rod with tipping paper.

Cigarettes typically comprise a wrapped tobacco rod that optionally is tipped with a filter. The tobacco rod comprises tobacco or other filler material such as tobacco substitutes, stems, or reconstituted tobacco which has been cut, shredded, extruded or otherwise prepared for incorporation in a tobacco product. The filter typically is either a plain filter (without charcoal) or a combination charcoal filter. Two types of combination charcoal filters are cavity fill filters and combined filters. A cavity fill filter has combining paper wrapped around spaced apart plain filter elements (typically having an acetate base material) with charcoal pieces in the gaps.

A combined charcoal filter has several filter elements, one being a segment of charcoal filter, which generally is a plain filter with carbon interspersed in the base material, the other being a segment of plain filter.

It is known to manufacture cigarettes having combined filters using a double-wrap process. In a double-wrap process, the combined filter is manufactured and wrapped first and then a second operation is performed to combine the filter and tobacco rod using tipping paper. More specifically, the plain and charcoal filter elements are fixed together with combining paper and are joined to the wrapped tobacco rod with tipping paper that is wrapped around a portion of the wrapped tobacco rod and the entire filter.

A single-wrap process, such as that taught in Okumoto U.S. Pat. No. 4,867,734, also is known. In the single-wrap process, unwrapped filter components and tobacco rod components are aligned next to each other. Typically, double and triple length components are fed to processing drums, cut and then spread apart. Additional filter components then are introduced between the cut and separated components. The added components generally must be spaced apart from the cut components, typically by gaps of 5 mm or more, in order to allow for manufacturing tolerances.

The gaps between the aligned components are closed either by (a) blowing the components closer together using an air stream; (b) using a series of compressing drums to close the gaps; or (c) using a swash ring drum to push the components together. A wrapped tobacco rod is placed at each end of the aligned filter elements and tipping paper is wrapped around the filter elements and a portion of the wrapped tobacco rod. A typical arrangement of combined charcoal filter tipped cigarettes has, arranged in series from the tip, a plain filter element, a charcoal filter element, and a wrapped tobacco rod.

The known double-wrap process possesses an number of known disadvantages. One such disadvantage is that separate machines are required to (1) join the plain and charcoal filter elements with combining paper, and (2) place the charcoal filter in alignment with the wrapped tobacco rod. It is a further disadvantage of the double-wrap process that separate machines occupy floor space and can result in increased machine maintenance and lost production time.

Another disadvantage of the double-wrap process is that at least two layers of paper are required to form filter tipped cigarettes.

The known single-wrap process also possesses a number of known disadvantages. One such disadvantage is that the spacing required between components to meet manufacturing tolerances results in a large total gap between the components during manufacturing.

Another disadvantage is that the gaps must be closed in order to join the wrapped tobacco rod to the filter.

A further disadvantage of the single-wrap process is that known processing drums for closing gaps can only move a limited distance. Typically, several processing drums are required in series in order to close the gaps.

A disadvantage of using compressed air to blow the cigarette components to close gaps is that a slow drum speed must be used to avoid overcoming the vacuum force holding the components to the drums. Typically the drum speed is limited to conveying 2000 cigarettes per minute.

A further disadvantage of blowing to close gaps is that the movement of the components produces friction which may damage the components.

Yet another disadvantage is that a source of pressurized air must be provided.

SUMMARY OF THE INVENTION

The present invention alleviates to a great extent the disadvantages of the prior art by providing an apparatus and method for manufacturing combined filter tipped cigarettes in which the components are aligned, gaps between the components are closed, and tipping paper is applied. More particularly, the various elements of a combined charcoal filter tipped cigarette are processed and aligned within the flutes of processing drums; the gaps between the components are narrowed using a motion limiting spreader drum; the gaps are closed using any apparatus, preferably a swash ring drum; and tipping paper is applied. In the preferred embodiment, a double-length wrapped tobacco rod is cut in the middle and the two pieces are spread on a spreader drum. A double-length charcoal filter plug is positioned between the spread wrapped tobacco rods. Then the double-length charcoal filter plug is cut in half and the halves are separated from each other on a motion limiting spreader drum equipped with an axial movement limiter. The limiter is an outer ring that holds the outermost components, which in the preferred embodiment are the wrapped tobacco rods, from moving axially, while the charcoal filter components continue to move apart. The gaps between the cut wrapped tobacco rod components and the cut charcoal filter components are thereby closed. A double-length plain filter component is then positioned between the spread charcoal filter components.

The gaps between all of the aligned components are closed on the swash ring drum and double-length tipping paper is applied. The joined cigarettes are cut in half by cutting in half the double-length plain filter component, thereby forming two cigarettes.

It is therefore an advantage of the present invention that combining paper is not required for manufacturing cigarettes with combined charcoal filters.

Another advantage of the present invention is that charcoal filter cigarettes are formed using a single machine using a series of processing drums.

Yet advantage of the present invention is that combining paper is not required to form combined charcoal filter tipped cigarettes.

A further advantage of the present invention is that gaps are closed during assembly of a combined charcoal filter cigarette through the use of a motion limiting spreader drum.

Still another advantage of the present invention is that combined charcoal filter tipped cigarettes can be formed on high speed cigarette making machines at rates exceeding 2000 cigarettes per minute.

BRIEF DESCRIPTION OF THE DRAWINGS

The above and other objects and advantages of the invention will be more apparent from the following detailed description and the accompanying drawings in which like reference characters represent like elements throughout, and in which.

DETAILED DESCRIPTION OF THE INVENTION

Figure 1:
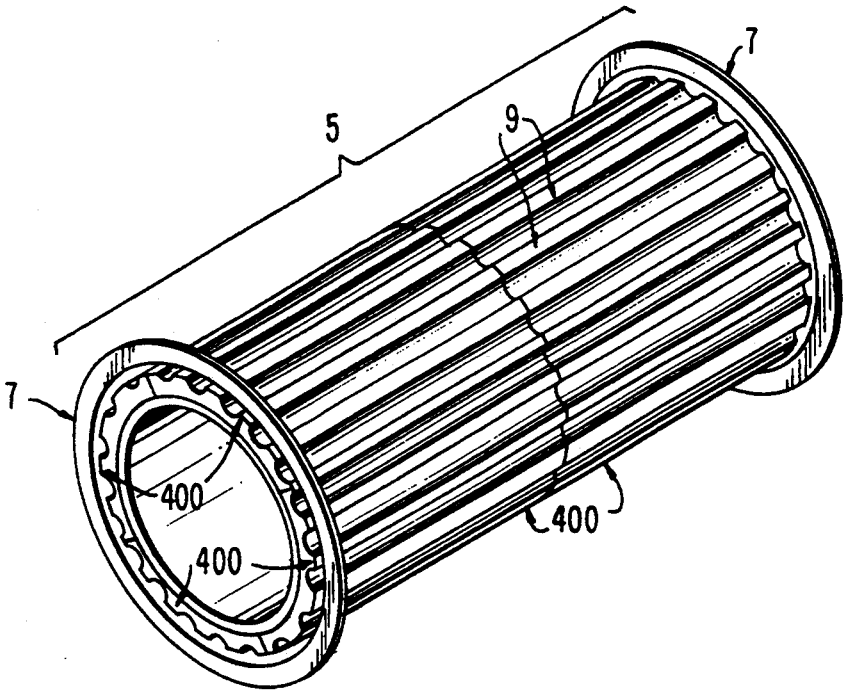
FIG. 1 is a perspective view of a motion limiting spreader drum in accordance with the present invention.

A combined filter tipped cigarette is produced on a cigarette making machine having processing drums, at least one of which is a motion limiting spreader drum. The cigarette components, including without limitation charcoal filter plugs, plain filter plugs and wrapped tobacco rods are fabricated by any manufacturing processes and are supplied by any supply apparatus such that they are provided to the cigarette making machine of the present invention. The cigarette components are combined using processing drums, including a motion limiting spreader drums 5, which incorporate outer spread limiting rings 7 to restrict lateral movement.

The cigarette components are cradled in horizontal flutes 9 located along the periphery of the processing drums. The rods are retained in the flutes through the application of a suction force. Any suction means may be used such that sufficient force is applied to the rods in the flutes in order to retain them within the flutes as the processing drums spin during machine operation. One such suction force means is described in commonly-assigned U.S. application Ser. No. 07/884,741, which issued as U.S. Pat. No. 5,232,079.

Various arrangements of filter components may be generated by the present invention. For example, the combined filter may have, in series from the tip, a plain filter plug, a charcoal filter plug and a plain filter plug. In the preferred embodiment discussed herein, the fully assembled cigarette comprises, in series from the tip, a plain filter plug, a charcoal filter plug and a wrapped tobacco rod.

Any length wrapped tobacco rods may be provided to the machine. However, in the preferred embodiment, double-length tobacco rods 15 are provided. Any apparatus for storing and transferring the tobacco rods to the tobacco rod receiving drum 20 may be used. The double-length rods 15 are then transferred to a tobacco rod cutting drum 30. Any apparatus for transferring cigarettes from one processing drum to another may be used to transfer the double-length rods (as well as for any transfer of components between processing drums in this application), such as the apparatus described in co-pending commonly-assigned U.S. application Ser. No. 07/884,741, supra. The tobacco rod cutting drum acts in conjunction with any cutting means, such as a blade or, preferably, a rotatable cutting plate 40 in order to cut the double-length tobacco rod in two—creating two generally single-length wrapped tobacco rods 45. The cut wrapped tobacco rods are then transferred to a tobacco rod spreader drum 50. The tobacco rod spreader drum 50 operates to spread the cut tobacco rods 45, creating a gap that is wide enough to receive a charcoal filter plug 55 and leave sufficient clearance between the ends of the charcoal filter plug 55 and the respective inner ends of the spread tobacco rods 45 in order to allow for manufacturing tolerances. In the preferred embodiment, a double-length charcoal filter plug 55 is inserted into the gap, as described below. In the preferred embodiment, gaps of 5 mm. are desired in order to meet manufacturing tolerances, although narrower or wider gaps may be used as required.

The cut tobacco rods 45 are transferred to a receiving drum 60. After transfer, the tobacco rods 45 preferably are separated by the same width gap as on the spreader drum 50 prior to transfer. The double-length charcoal filter 55 also preferably is transferred to the receiving drum 60. In the preferred embodiment depicted in FIGS. 2 and 3, the generally cylindrical double-length charcoal filter 55 is received in the center of the receiving drum 60 and then the drum rotates and the cut and spread wrapped tobacco rods 45 are transferred to the receiving drum 60 such that the double-length charcoal filter plug 55 is in between the two tobacco rods.

Figure 2:
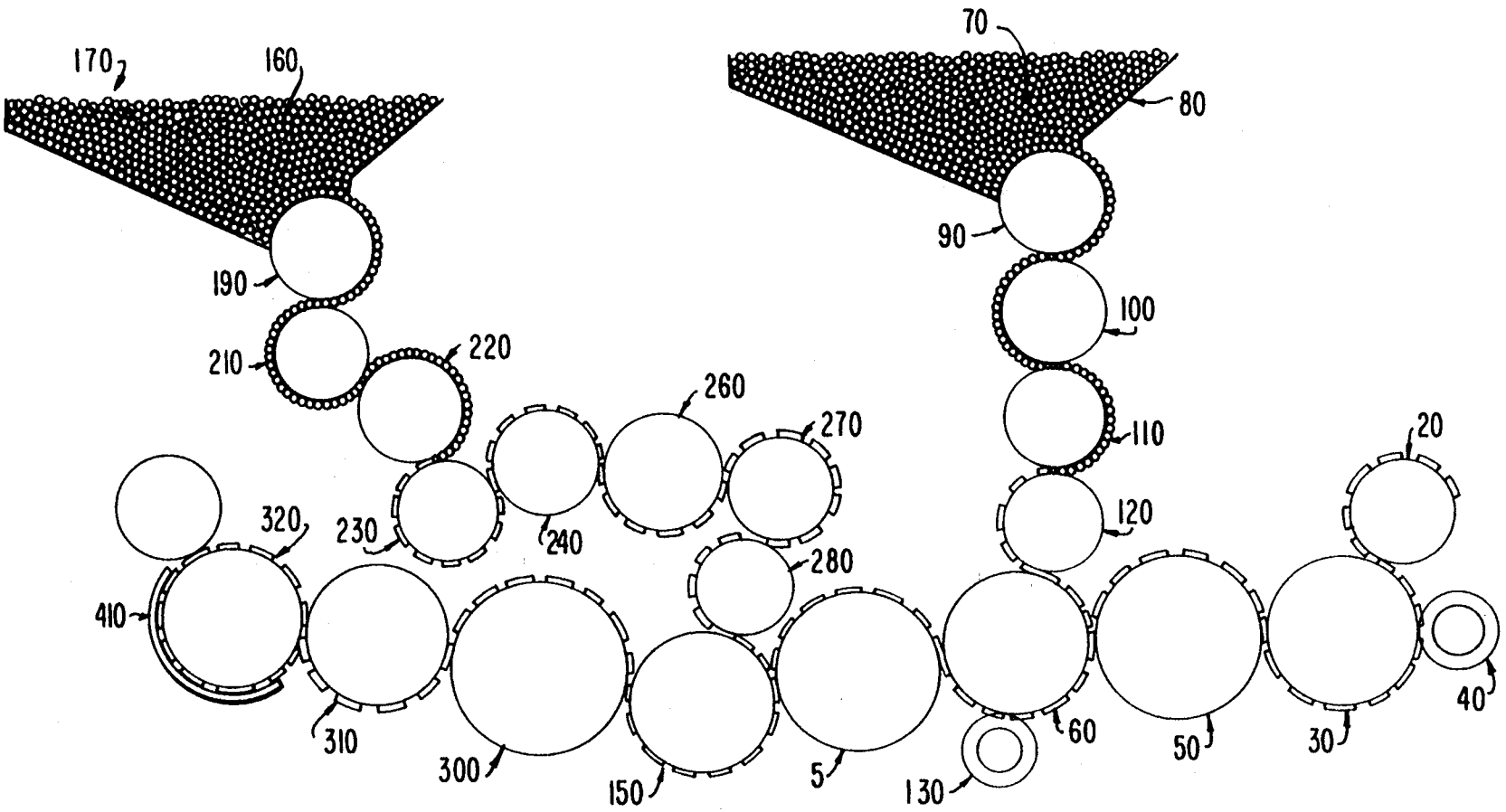
FIG. 2 is a schematic view of a charcoal filter-tipped cigarette making machine in accordance with the present invention.

The charcoal filter plug 55 may be supplied directly to the receiving drum 60, or alternatively may be supplied after preliminary processing on the cigarette making machine of the present invention. As depicted in FIG. 2, the charcoal filter plugs 70 are stored in a hopper 80. Any length charcoal filter plugs may be provided. The charcoal filter plugs are then processed such that the desired length plug is supplied at the required speed such that the flutes of the receiving drum 60 receive the charcoal filter plugs. In the preferred embodiment, sextuple-length charcoal filter plugs 70 are supplied. The charcoal filter plugs are then cut and spaced such that cut double-length plugs are received by receiver drum 60.

In one embodiment, the sextuple-length charcoal filter plugs 70 are received from the hopper 80 by cutting drum 90. The sextuple-length plugs 70 are cut twice on cutting drum 90, producing three double-length charcoal filter plugs 55. The cut double-length charcoal filter plugs 55 are transferred to grading drum 100, which staggers the three double-length charcoal filter plugs so that they are no longer axially aligned, as shown at reference numeral VI of FIG. 3. The staggered double-length charcoal filter plugs 55 are then transferred to aligning drum 110, which aligns each double-length charcoal filter plug such that it is in the middle of the drum, as depicted at reference numeral VII of FIG. 3. The double-length charcoal filter plugs are then transferred to accelerator drum 120, which accelerates the double-length filter plugs such that each flute of the receiver drum 60 has transferred to it a single double-length charcoal filter plug 55. In the preferred embodiment, the accelerator drum 120 rotates three times faster than the aligning drum 110. In this instance, and with reference to other spreader, grading, aligning and accelerator drums discussed in this description, any spreader, grading, aligning or accelerator drums, respectively, or other such apparatus, may be used.

The double-length charcoal filter plug 55 on receiving drum 60 is cut such that two single-length charcoal filter plugs 125 are produced. Any cutting means may be used, such as a blade or, preferably, rotatable cutting plate 130. The wrapped tobacco rods 45 and single-length charcoal filter plugs 125 are transferred to a motion limiting spreader drum 5, which operates to (a) spread the two single-length charcoal filter plugs 125, creating a gap that is wide enough to receive a plain filter plug and leave sufficient clearance between the ends of the plain filter plug and the respective inner ends of the single-length charcoal filter plugs 125 in order to allow for manufacturing tolerances; and (b) limit the outward movement of the tobacco rods 45, through the operation of the outer spread limiting rings 7 such that the gaps between the tobacco rods 45 and single-length charcoal filter plugs 125 are narrowed. Preferably, a double-length plain filter plug 145 is provided. In the preferred embodiment, gaps of 5 mm. between the double-length plain filter plug and the respective inner ends of the single-length charcoal filter plugs 125 are desired in order to meet manufacturing tolerances, although narrower or wider gaps may be used as required.

A motion limiting spreader drum 5 is illustrated in FIG. 1. The drum 5 comprises spreader plates 400. Each plate has flutes 9 in which the cigarette and filter components are cradled. Preferably suction is applied through the flutes such that any resident components are retained in the flutes. The retaining force must be sufficiently strong such that the resident components are retained in place as the drum rotates, often at high speeds. Any number of plates may be provided circumferentially around the drum 5. In the preferred embodiment, a total of eight plates 400 is provided—two sets of four opposing plates on each half of the drum. In operation, the opposing plates are adjacent to each other, without any gap, when receiving cigarette components. Then, as the drum rotates, the opposing plates spread, thereby spreading apart the components and creating a gap. Any apparatus, may be used to spread the plates 400, such as cams or gears. The motion limiting spreading drum also incorporates an axial movement limiter, which restricts the axial movement of the outermost components (i.e., tobacco rods in the preferred embodiment) residing in the flutes 9, but not the innermost components (i.e., single-length charcoal filters 125, in the preferred embodiment) as the plates 400 are spread. In the preferred embodiment, the axial movement limiter comprises two rings 7, which are mounted at each end of the drum 5.

In operation, once the components are spread a predetermined distance (3 mm. in the preferred embodiment), the outer ends of the single-length wrapped tobacco rods 45 residing in the flutes 9 impinge upon the rings 7 and thereby are prevented from spreading apart further. However, the plates 400 continue moving apart, thereby continuing to spread the single-length charcoal filter plugs 55. The charcoal filter plugs 125 continue spreading until their outer ends preferably are within 1 mm of the wrapped tobacco rods' 45 inner ends. In the preferred embodiment, the plates 400 stop spreading before the charcoal filter plugs 125 impinge upon the tobacco rods 45, leaving a gap. Preferably the remaining gap is generally 1 mm, although wider or narrower gaps may be used. It is preferable for the plates to stop spreading in order to prevent contact, which may lead to components popping off of the drum at high speeds of operation. In order to create the desired 24 mm. gap, the plates 400 must spread apart 24 mm.

Preferably, the plates spread apart farther than the desired amount and have a return distance, creating a clearance between the rings 7 and the outer edges of the wrapped tobacco rods 45, such that when the components are transferred from the motion limiting spreader drum 5 there is no contact between rings 7 and the tobacco rods 45. In one embodiment, there is a return distance of 2 mm., creating 1 mm gaps between each of the rings 7 and the adjacent tobacco rods 45.

Figure 3:
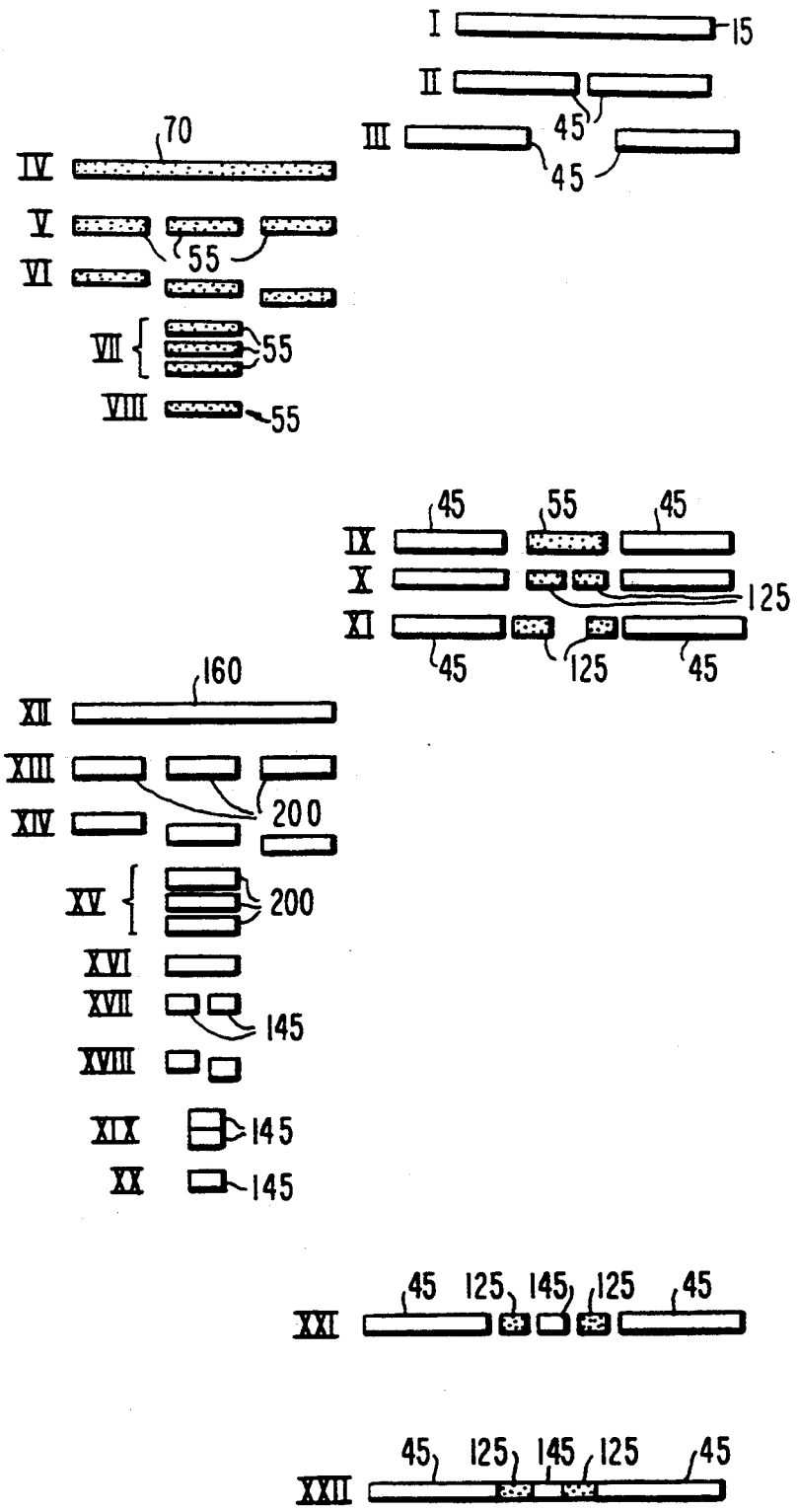
FIG. 3 is a flow sheet illustrating the processing steps of forming a charcoal filter-tipped cigarette in accordance with the present invention.

The spread tobacco rods 45 and single-length charcoal filter plugs 125 are transferred to a second receiving drum 150, which receives a double-length plain filter plug 145 into the gap between the single-length charcoal filter plugs as depicted by reference numeral XXI of FIG. 3. The double-length plain filter plug 145 may be supplied directly to the receiving drum 150, or alternatively may be supplied after preliminary processing on the cigarette making machine of the present invention. As depicted in FIG. 2, plain filter plugs 160 are stored in a hopper 170. Any length plain filter plugs may be provided. The plain filter plugs are then processed such that the desired length plug is supplied at the required speed such that the flutes of the receiving drum 150 receive the plain filter plugs. In the preferred embodiment, twelve-length plain filter plugs 160 are supplied. The plain filter plugs are then cut and spaced such that cut double-length plugs are received by receiving drum 150.

In one embodiment, the twelve-length plain filter plugs 160 are received from the hopper 170 by cutting drum 190. The twelve-length plugs 160 are cut twice on cutting drum 190, producing three quadruple-length plain filter plugs 200. The cut quadruple-length plain filter plugs 200 are transferred to grading drum 210, which staggers the three quadruple-length plain filter plugs as shown at reference numeral XIV of FIG. 3. The staggered quadruple-length plain filter plugs 200 are then transferred to aligning drum 220, which aligns each quadruple-length plain filter plug 200 such that it is in the middle of the drum, as depicted at reference numeral XV of FIG. 3. The quadruple-length plain filter plugs 200 are then transferred to accelerator drum 230, which accelerates the quadruple-length filter plugs such that each flute of the next drum, cutting drum 240, has transferred to it a single quadruple-length plain filter plug. Cutting drum 240, as depicted at reference numeral XVII of FIG. 3 operates to cut in two each quadruple-length plain filter plug, creating two double length plain filter plugs 145. The cut double-length plain filter plugs 145 are transferred to grading drum 260, which staggers the two double-length plain filter plugs 145 as shown at reference numeral XVII of FIG.

3. The staggered double-length plain filter plugs 145 are then transferred to aligning drum 270, which aligns each quadruple-length plain filter plug 145 such that it is in the middle of the drum, as depicted at reference numeral XIX of FIG. 3. The double-length plain filter plugs are then transferred to accelerator drum 280, which accelerates the double-length plain filter plugs such that each flute of the receiving drum 150 has transferred to it a single double-length plain filter plug 145.

In the preferred embodiment, the double-length plain filter plug 145 is received by receiving drum 150. Then as the receiving drum rotates further, the cut and spread charcoal filter plugs 125 and the wrapped tobacco rods 45 are received. After all the components are received, the components are arranged in flutes on the receiving drum 150 as depicted at reference numeral XXI of FIG. 3. Downstream of the receiving drum 150, the arranged cigarette components are received by a swash ring drum. In the embodiment depicted in FIG. 2, the arranged components are first transferred to two idling drums 300, 310 in series and then are transferred to swash ring drum 320.

The gaps between each of the components are closed on the swash ring drum 320, and tipping paper is applied such that the plain filter plug 145 and charcoal filter plugs 125 are covered and a portion of each wrapped tobacco rod 45 adjacent to the charcoal filter plugs 145 is covered. Stationery swash rings are mounted at a pre-set angle adjacent to the drum. As the drum rotates, the wrapped tobacco rods are forced to slide within the flutes inwardly, in the direction dictated by the rings thereby (a) closing the gaps between the wrapped tobacco rods 45 and the single-length charcoal filter plugs 125; (b) causing the inner edges of the wrapped tobacco rods 45 to impinge upon the outer edges of the single-length charcoal filter plugs 125; (c) closing the gaps between the charcoal filter plugs 125 and the plain filter plug 145.

EXAMPLE

Combined charcoal filter-tipped cigarette was formed using the steps depicted in FIG. 3. In Steps I–III, the wrapped tobacco rods were prepared. Step I shows a double-length wrapped tobacco rod 15. In Step II, the double-length rods 15 were cut in the middle on a cutting drum, creating two single-length tobacco rods 45. In Step III, the single-length rods were spread apart on a spreader drum, creating gaps of 48 mm.

In Steps IV–VII, the Charcoal filter plugs were prepared. Step IV shows a sextuple-length charcoal filter plug 70. In Step V, the sextuple-length charcoal filter plugs 70 were cut in two places on a cutting drum, creating three double-length charcoal filter plugs 55. In Step VI, the double-length charcoal filter plugs 55 were staggered on a grading drum. In Step VII, the double-length charcoal filter plugs were aligned on an aligning drum. In Step VIII, the double-length charcoal filter plugs 55 were accelerated on an accelerator drum.

In Steps IX–XI, the double-length charcoal filter plugs 55 were oriented with the spread wrapped tobacco rods 45. In Step IX, the double-length charcoal filter plugs 55 were received between the spread wrapped tobacco rods 45 on a receiver drum. There were gaps of generally 5 mm. between the inner ends of the wrapped tobacco rods 45 and the two ends of the double-length charcoal filter plugs 55. In Step X, the double-length charcoal filter plugs 55 were cut in the middle using a cutting plate, creating single-length charcoal filter plugs 125. In Step XI, the components were spread on a motion limiting spreader drum, creating a gaps of about 24 mm. between the two single-length charcoal filter plugs and closing to 1 mm. the gaps between the inner ends of the wrapped tobacco rods 45 and the outer ends of the single-length charcoal filter plugs.

In Steps XII–XX, plain filter plugs were prepared. Step XII shows a twelve-length plain filter plug 160. In Step XIII the twelve-length plain filter plugs 160 were cut in two places on a cutting drum, creating quadruple-length plain filter plugs 200. In Step XIV, the quadruple-length plain filter plugs 200 were staggered on a grading drum. In Step XV, the quadruple-length plain filter plugs were aligned on an aligning drum. In Step XVI, the quadruple-length plain filter plugs 200 were accelerated on an accelerator drum. In Step XVII, the quadruple-length plain filter plugs were cut in half on a cutting drum, creating double-length plain filter plugs 145. In Step XVIII, the double-length plain filter plugs 145 were staggered on a grading drum. In Step XIX, the double-length plain filter plugs were aligned on an aligning drum. In Step XX, the double-length plain filter plugs 145 were accelerated on an accelerator drum.

In Steps XXI–XXII, double length cigarettes were formed. In Step XXI, double length plain filter plugs 145 were received on a receiving drum in the gaps between the single-length charcoal filter plugs. In Step XXII, the gaps between the components were closed on a swash plate drum and tipping paper was applied. In further processing, the cigarettes were formed by cutting in half the plain filter plugs.

Thus, it is seen that an apparatus and method for manufacturing charcoal filter tipped cigarettes is provided. One skilled in the art will appreciate that the present invention can be practiced by other than the preferred embodiments which are presented for purposes of illustration and not of limitation, and the present invention is limited only by the claims which follow.

What is claimed is:

1. A method of manufacturing filter tipped cigarettes, comprising:

separately supplying spaced apart first and second single-length tobacco rods and first and second single-length first filter plugs to respective cigarette component holding channels on a drum with the first and second single-length first filter plugs located between adjacent ends of the spaced apart first and second tobacco rods with respective first gaps between the respective ends of the first and second single-length first filter plugs and the adjacent ends of said tobacco roads and a second gad between the first and second single-length first filter plugs;

spreading apart the cigarette component holding channels at the second gap to open the second gap between the first and second single-length first filter plugs; and restricting the outward axial movement of the single-length tobacco rods in the channels during said spreading apart of the channel such that said respective first gaps narrow while the second gad opens.

2. The method of claim 1, wherein said spreading apart step further comprises spreading apart the first and second single-length first filter plugs axially such that the opened second gap is greater than the length of a double-length second filter plug.

3. The method according to claim 2 wherein said first filter plugs are charcoal filter plugs and said second filter plug is a plain filter plug.

4. The method of claim 2, further comprising the step of supplying double-length second filter plugs into the opened second gap between the spread apart first and second filter plugs.

5. The method according to claim 4 wherein said first filter plugs are charcoal filter plugs and said second filter plugs are plain filter plugs.

6. The method according to claim 4, wherein said restricting step comprises positioning at the channels a stop which is relatively stationary with respect to spreading apart channels, wherein a respective outer end of the first and second tobacco rods in the channels impinge on the stops and are stopped thereby.

7. The method according to claim 6, further comprising moving the channels relatively closer together to create a clearance between the stops and outer ends of the tobacco rods.

8. The method of claim 4 further comprising the step of applying a swashing action to said tobacco rods, first filter plugs and second filter plugs such that said tobacco rods are brought relatively closer to said first filter plugs and said first filter plugs are brought relatively closer to said second filter plugs.

9. The method according to claim 8 wherein said first filter plugs are charcoal filter plugs and said second filter plugs are plain filter plugs.

10. The method of claim 8, further comprising the step of joining said tobacco rods, first plugs and second single-length first filter plugs to form double-length cigarettes.

11. The method according to claim 10 wherein said first filter plugs are charcoal filter plugs and said second filter plugs are plain filter plugs.

12. The method of claim 10 further comprising the step of cutting said double-length cigarettes at the double-length second filter plugs to yield two single-length cigarettes.

13. The method according to claim 12 wherein said first filter plugs are charcoal filter plugs.

14. The method of claim 1 wherein said spreading apart step comprises moving apart the underlying channel.

15. The method of claim 1, further comprising the step of moving together the first and second single-length first filter plugs such that the second gap therebetween is narrowed.

16. The method according to claim 15 wherein said first filter plugs are charcoal filter plugs.

17. The method according to claim 1 wherein said first filter plugs are charcoal filter plugs.

18. The method according to claim 1, wherein said restricting step comprises positioning at the channels a stop which is relatively stationary with respect to the spreading apart channels, wherein a respective outer end of the first and second tobacco rods in the channels impinge on the stops and are stopped thereby.

19. The method according to claim 18, further comprising moving the channels relatively closer together to create a clearance between the stops and outer ends of the tobacco rods.

* * * * *